United States Patent [19]

Barker

[11] Patent Number: 4,920,883

[45] Date of Patent: May 1, 1990

[54] DETONATION TRANSFER METHODS AND APPARATUS

[75] Inventor: James M. Barker, Katy, Tex.

[73] Assignee: Halliburton Logging Services, Inc., Houston, Tex.

[21] Appl. No.: 302,180

[22] Filed: Jan. 27, 1989

[51] Int. Cl.[5] ..... F42B 19/08; F42B 19/12; F42D 1/04

[52] U.S. Cl. ..... 102/202.5; 102/275.5; 102/275.6

[58] Field of Search ..... 102/275.1, 275.2, 275.3, 102/275.4, 275.6, 275.5, 275.7, 202.5, 275.11, 701

[56] References Cited

U.S. PATENT DOCUMENTS

| | | | |
|---|---|---|---|
| 3,180,264 | 4/1965 | Webb | 102/275.4 |
| 3,209,692 | 10/1965 | Webb | 102/275.4 |
| 3,460,477 | 8/1969 | Heidemann et al. | 102/275.2 |
| 3,991,679 | 11/1976 | Savitt et al. | 102/275.4 |
| 4,112,845 | 9/1978 | Savitt | 102/275.3 |
| 4,239,003 | 12/1980 | Savitt | 102/275.5 |
| 4,314,508 | 2/1982 | Love | 102/275.3 |
| 4,660,472 | 4/1987 | Stevens | 102/275.3 |
| 4,753,170 | 6/1988 | Regalbuto et al. | 102/701 |
| 4,754,704 | 7/1988 | Lübbers | 102/275.11 |
| 4,759,291 | 7/1988 | Barker et al. | 102/202.5 |

*Primary Examiner*—David H. Brown
*Attorney, Agent, or Firm*—William J. Beard

[57] ABSTRACT

In a high pressure, high temperature detonator for deep well use, an improved device is disclosed. It includes an elongate housing with axial bore and an electrical conductor at one end. A first explosive initiator is electrically ignited. In turn, a sleeve having a transverse bulkhead aligns one or more secondary explosive transfer pellets. The transfer pellets cooperate in ignition of the detonating cord. The secondary explosive pellets and sleeve are configured into described shapes to focus the shock wave for cord ignition.

2 Claims, 2 Drawing Sheets

DETONATION TRANSFER METHODS AND APPARATUS

BACKGROUND OF THE INVENTION

A common method of perforating oil and gas wells for the production of petroleum and hydrocarbon gases is to use perforating guns wherein the explosive trains (i.e. the detonator, detonating cord and shaped charges) are exposed to wellbore fluids. It is possible in hot deep wells to encounter temperatures in excess of 500° F. and pressures over 20,000 psi. Thus, considerable stress can be placed on the explosive train, particularly the detonating cord since it is encased in a pressure transmitting jacket which subjects the explosive in the cord to the simultaneous influence of temperature and pressure. Explosives decompose at some finite rate under the influence of heat. They tend to decompose even faster when both high pressure and high temperature are present. Because of the nature of its function in high temperature wellbores, it is necessary to manufacture detonating cords from thermally stable explosive compounds. Two such explosives which are commonly used for this purpose are known as PYX and ONT. Both of these thermally stable detonating compounds possess excellent thermal stability, up to 500° F. for 100 hours, and are relatively easy and inexpensive to manufacture.

Unfortunately, however, detonating cords made from these explosives can be difficult to initiate or start in the explosive process. Three factors which can contribute to the difficulty in initiating these compounds are:

(1) the inherent thermal stability of many high temperature explosives makes them insensitive, not only to heat, but usually to other initiation stimuli such as shock or impact;

(2) downhole pressure acting on the detonating cord increases its density which tends to decrease the explosive sensitivity of the cord; and (3) the explosive particle size that is best for detonating cord manufacture is usually not conducive to initiation.

Thus detonating cords which contain thermally stable explosives under the influence of downhole wellbore pressure can be extremely difficult to initiate. Conventional detonators simply might not generate sufficient shock strength to initiate these detonating cords.

A detonator package for use in this type of environment is described in U.S. Pat. No. 4,759,291 which is assigned to the common Assignee of the present application. This patent and its disclosure are incorporated herein by reference. Even utilizing a detonator package such as that described in the foregoing patent one may encounter difficulty in initiating high temperature cords. However, it may be possible to improve the functioning of a detonator device such as that shown in the aforementioned U.S. patent by using special detonation transfer techniques and apparatus. Such techniques and apparatus are the subject of the present application.

BRIEF DESCRIPTION OF THE INVENTION

Briefly, the present invention contemplates the use of methods and apparatus for the detonation or initiation of detonating cord under high temperature and pressure wellbore conditions. Utilizing the concepts of the present invention, the aforementioned difficulties encountered with apparatus of the type described in the previously mentioned U.S. patent may be overcome. According to the present invention, the use of a thermally stable secondary explosive initiating compound in conjunction with the detonating cord and the geometry of particular devices for this purpose can improve the initiation of detonating cord. Several thermally stable secondary explosive initiating compounds are suggested for this purpose. Similarly, a shock wave focusing lens which focuses the initiator energy onto a concentrated area or section of the detonating cord or initiating compound can be utilized. Finally, the technique of using triple wave interaction can be used to improve the initiation of the detonating cord.

The above and other features and advantages of the present invention can be better understood by reference to the detailed description to follow when taken in conjunction with the accompanying drawings. The accompanying drawings are intended to be illustrative of the present invention without being limitative on the aspects of its incorporation. These drawings are provided in an attempt to explain the workings of the invention to those skilled in the art.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DESCRIPTION OF THE PREFERRED EMBODIMENTS

Figure 1:
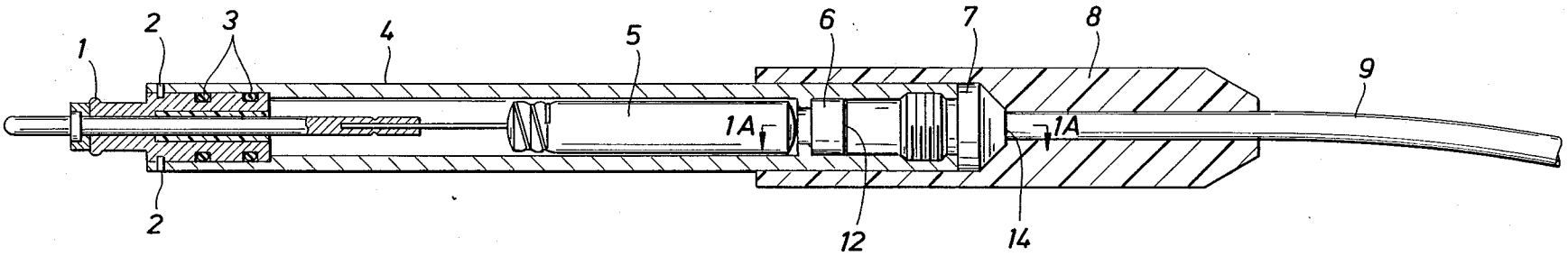
FIG. 1 (PRIOR ART)
FIG. 1 is a longitudinal sectional view illustrating an apparatus for a through bulkhead explosive initiator in which concepts of the present invention may be utilized.
Figure 1A:
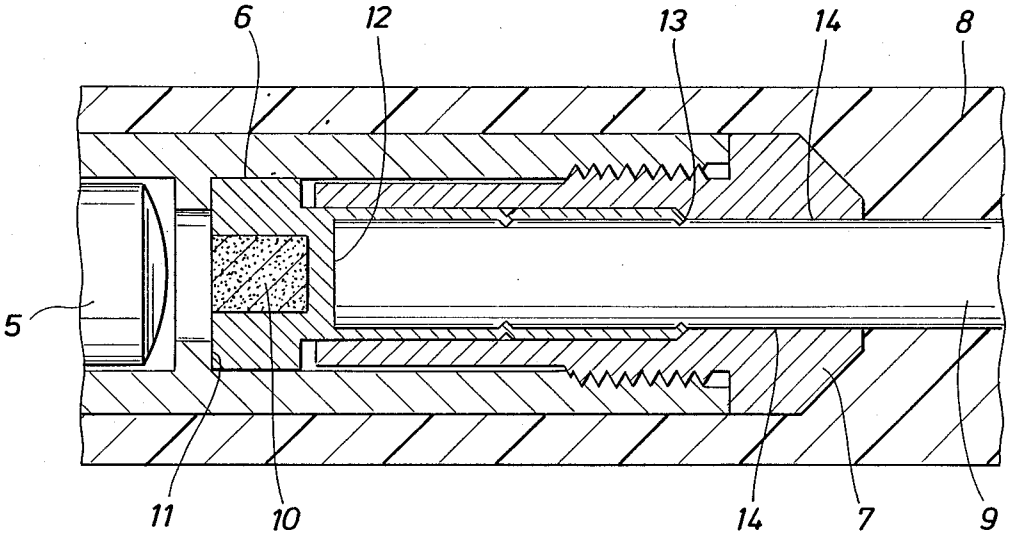
FIG. 1A (PRIOR ART)
FIG. 1A is an enlarged detail shown in sectional view showing a bulkhead and secondary explosive in the initiator apparatus according to the present invention.

Referring initially to FIGS. 1 and 1A, a detonator device such as illustrated in U.S. Pat. No. 4,759,291 is shown in sectional view and detailed sectional view. It will be understood that the concepts according to the present invention may be applied to the apparatus of FIGS. 1 and 1A with the modifications as shown and discussed with respect to the added views herein.

In FIG. 1 an explosive initiator comprising a pressure resistant housing 4 is hermetically sealed at the upper end with an electrical feedthrough connector 1. A set of retaining pins 2 retains the feedthrough connector 1 while the elastomeric O-rings 3 prevent fluid leakage into the interior of housing 4. An explosive device 5 is attached to the electrical feedthrough 1. This device 5 may be a conventional hot-wire detonator commonly called a blasting cap, an exploding bridgewire detonator, or an exploding foil detonator.

A cooperative portion of the initiator comprises a crimp sleeve 6 that contains a pressed pellet of secondary explosive 10 in its upper end. This pressed pellet of secondary explosive is sometimes referred to as a booster load. The concepts of the present invention extend to improvements in the geometry as well as to other aspects of the initiator of FIG. 1.

The lower end of crimp sleeve 6 is designed to slide over the detonating cord 9. It is retained thereto by crimping onto the detonating cord with suitable hand crimps in a manner well known in the art. The crimp sleeve 6 and the attached detonating cord 9 slip inside the housing 4 and abut the shoulder 11. The bulkhead 12 is shown in more detail in FIG. 1A. This is an integral part of the crimp sleeve 6. The bulkhead 12 prevents the detonating cord 9 from extruding forward due to the piston effect from wellbore fluid pressure acting on the cross-sectional area of the detonating cord and forcing it internally in the housing 4. For typical cross-sectional areas of detonating cord such a force can be as much as 700 pounds in a 20,000 psi wellbore.

A retainer 7 is threaded into the end of the housing 4 so that it retains the crimp sleeve 6 against the shoulder 11. A metal to metal seal is formed at the interface 13 between the crimp sleeve 6 and the retainer 7. This prevents the detonating cord 9 extruding through any gaps into the interior of the initiator housing 4. The pressurized detonating cord also expands radially very slightly and closes the clearance gap 14 between the retainer 7 and the cord 9. This expansion allows an elastomeric boot 8 to form a high pressure seal at the lower end of the initiator. Extrusion of the boot 8 into the initiator is not possible since the clearance gap 14 has now been closed due to the aforementioned radial expansion of the pressurized detonating cord.

Figure 2:
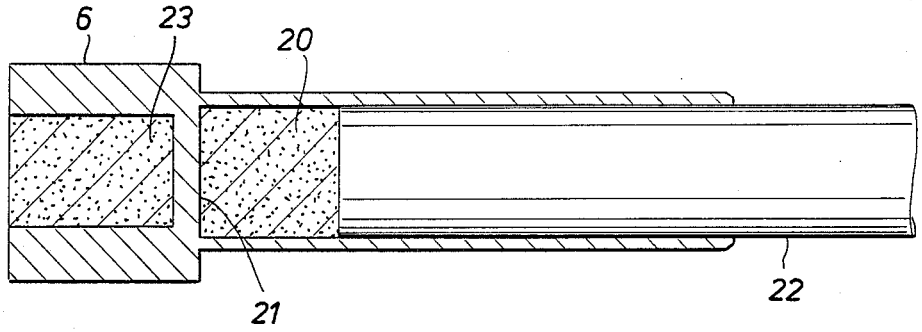
FIG. 2 is a further detail of a portion of the initiator of FIG. 1 utilizing one of the improvement concepts of the present invention.

Detonation transfer across the barrier 12 of FIG. 1 takes place only if the shock pressure generated by the explosive 10 is of sufficient magnitude to initiate the insensitive high explosive in the detonating cord. Often it is not. A special technique which can be applied to assure detonation transfer is to utilize, between the barrier 12 and detonating cord 9, a small quantity of a high temperature secondary explosive which is more sensitive to initiation than ONT or PYX. Such explosives are frequently referred to as thermally stable secondary explosive initiating compounds. These include such explosives as:

Table I (1) ABH—azobis(2,2',4,4',6,6'hexanitrobiphenyl
(2) DODECA—2,2',2'',2''',4,4',4'',4''',6,6',6'',6''' dodecanitro—m,m' quatraphenyl
(3) NONA—2,2',2'',4,4',4'',6,6',6'' nonanitroterphenyl
(4) TNTPB—1,3,5—trinitro 4,6—tripicrylbenzene
(5) DPO—2,5—dipicryl 1,3,4—oxadiazole The sensitivity of these explosives is derived both from chemical formulation and explosive particle size. Typically, the particle size which is best for explosive initiation is rather fine (even fluffy) which does not lend itself to detonating cord manufacture. Also, certain initiating compounds can be rather difficult and expensive to make. However, it is possible to place a small quantity of one of these initiating compounds as shown in FIG. 2 at a location 20 between the barrier 21 and the detonating cord 22. The incident shock wave from the source or donor explosive 23 (corresponding to the pellet 10 of FIG. 1), heretofore unable to initiate the insensitive high explosive detonating cord directly, is now able to initiate the more sensitive initiating compound 20 chosen from the table of thermally stable secondary explosives given above. The detonation pressure created by the initiating compound 20 is then sufficient to cause initiation of the detonating cord 22.

Figure 3:
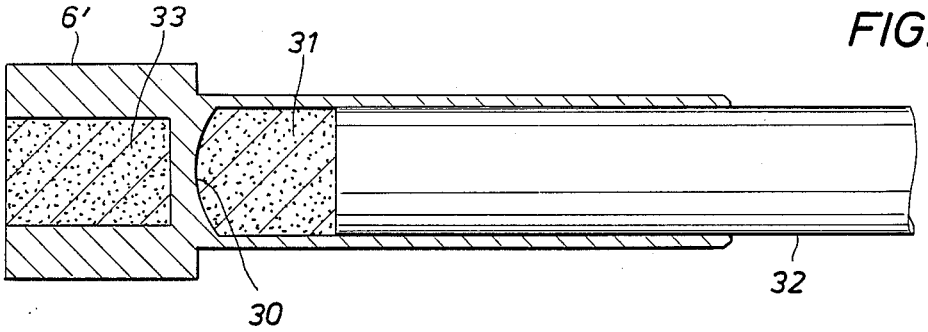
FIG. 3 is a further cross-sectional detail view of a portion of the apparatus of FIG. 1 showing further concepts according to the present invention.

Referring now to FIG. 3 (similar to FIG. 2), the same portion of the detonating apparatus is shown in cross section. The crimp sleeve 6 (see FIG. 1) has a concave barrier 30 corresponding to barrier 12 of FIG. 1. The concave barrier 30 focuses the shock wave from the source or donor explosive 33. Differences in shock impedance between the barrier 30 and the explosive 31 create a focusing effect. The explosive 31 may be a thermally stable secondary explosive from the list above. The transmitted shock wave from the donor explosive 33 converges at a point within the thermally stable initiating compound 31 due to the focusing effect of the concave surface. At this convergence point the pressure is sufficiently high to cause the shock initiation of the explosive 31 which then propagates to the detonating cord 32. Thus, the donor explosive 33 shock wave is focused by the concave lens 30 onto the thermally stable secondary initiator 31 which in turn detonates to trigger detonating cord 32.

Figure 4A:
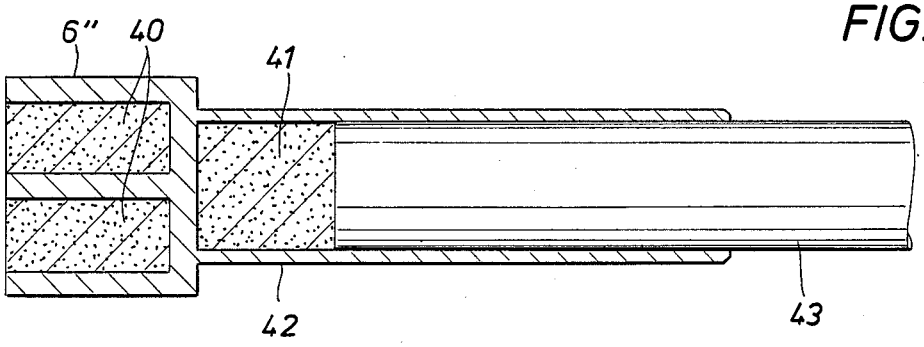
FIG. 4A is another sectional view in more detail showing yet another embodiment of concepts according to the present invention taken along the line 4A—4A of FIG. 4C.
Figure 4B:
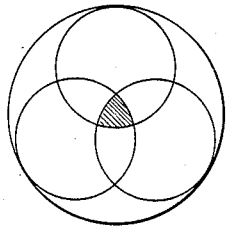
FIG. 4B is a schematic diagram illustrating a triple wave interaction according to concepts of the invention.
Figure 4C:
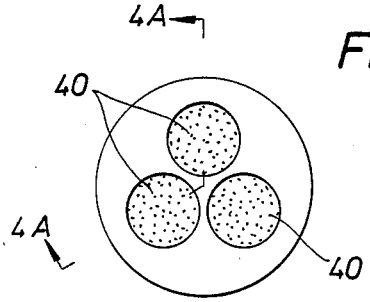
FIG. 4C illustrates the geometrical arrangement of secondary explosive initiators according to concepts of the present invention utilized in the apparatus of FIG. 4A.

Finally, referring to FIGS. 4A, 4B and 4C, a geometrical explosive convergence principle which may be termed "triple wave interaction" is illustrated schematically. A crimp sleeve corresponding to the crimp sleeve 6 in FIG. 1 is arranged such that the single cylinder of pressed explosive 10 of FIG. 1 is now replaced by three smaller cylinders 40 of pressed explosives. When these three explosive pellets are simultaneously initiated at the upper end, they each propagate expanding shock waves which collide and reinforce along the axis of the crimp sleeve as illustrated in FIG. 4B. Along this axis, the shock wave pressure is multiplied sufficiently high to initiate either the insensitive detonating cord 43 directly or an initiating compound 41, a stable secondary explosive placed between the barrier 42 and the detonating cord 43. In FIG. 4B, the shaded area represents the region of highest pressure generated by the interaction of shock waves from the three explosive pellets 40.

The foregoing descriptions may make other alternative arrangements according to the concepts of the present invention apparent to those skilled in the art. It is therefore the aim in the appended claims to cover all such changes and modifications as fall within the true spirit and scope of the invention.

What is claimed is:

1. A fluid tight sealed housing and detonation transfer apparatus for well borehole use in high temperature and pressure wells where explosive train components are exposed, and are heated and pressurized by well borehole fluid, comprising:

(a) a generally elongate cylindrically shaped housing member having a bore therethrough and having an upper end and a lower end, said bore having a shoulder in the lower end of said housing member;

(b) an electrical conductor having a feedthrough connector entering said bore at said upper end of said housing member cooperative with a first hermetic seal means between said feedthrough connector and said housing member;

(c) an explosive initiator carrier in said bore above said shoulder and electrically coupled to said electrical conductor;

(d) sleeve means, being generally cylindrically shaped and sized on its lower end to internally receive a detonating cord and having a bulkhead at the upper end thereof, said bulkhead on the upper surface thereof having at least three axially symmetrically arranged cylindrical recesses sized to receive three axially symmetrically arranged cylindrical shaped pellets of secondary explosive which are capable of simultaneous detonation to form a triple interaction zone of shock wave propagation along a central axis of said sleeve means thereby intensifying said shock wave propagation across said bulkhead, said bulkhead further having a lower surface shaped to axially focus any shock wave transversing said bulkhead along the central axis of said sleeve means thereby intensifying such shock wave, said first charge of secondary explosive functioning as a booster load for propagating a shock wave initiated by said explosive initiator across said bulkhead and into the portion of said sleeve means below said bulkhead, a second charge of secondary explosive below said bulkhead and adjacent a detonating cord entering said sleeve means from its lower end, said second charge of secondary explosive functioning as an additional booster load for further propagating any shock wave initiated by said explosive initiator and boosted by said first charge of secondary explosive, the detonation of said second charge of secondary explosive enabling the initiation of said detonating cord;

(e) retaining means for fixedly retaining said sleeve means in said bore of said housing member; and (f) separate metal to metal seal means for fluid tight sealing said retaining means to said housing member at its lower end such that said housing member is sealingly connected to said electrical conductor at one end thereof and said detonating cord at the opposite end thereof.

2. The apparatus of claim 1 wherein said second charge of secondary explosive is chosen from the group of ABH, DODECA, NONA, TNTPB and DPO.

* * * * *